US005707262A

United States Patent [19]

Huntley et al.

[11] Patent Number: 5,707,262

[45] Date of Patent: Jan. 13, 1998

[54] WIRELESS TRIM CONTROL SYSTEM FOR BOAT DRIVE

[76] Inventors: Jeffery W. Huntley, 178 Inwood Trail, Madison, Ala. 35758; William F. Huntley, 206 Wellington Rd., Athens, Ala. 35611

[21] Appl. No.: 636,248

[22] Filed: Apr. 23, 1996

[51] Int. Cl.[6] ..... B63H 5/12

[52] U.S. Cl. ..... 440/61; 114/144 R; 74/484 R

[58] Field of Search ..... 440/61, 53, 900, 440/113; 114/144 R; 180/78; 307/310.1; 340/825.72; 74/484 R

[56] References Cited

U.S. PATENT DOCUMENTS

| | | | |
|---|---|---|---|
| 4,405,924 | 9/1983 | Shinoda et al. | 340/825.72 |
| 4,684,918 | 8/1987 | Solomon | 340/73 |
| 5,337,694 | 8/1994 | Nix et al. | 114/144 R |

*Primary Examiner*—Ed L. Swinehart
*Attorney, Agent, or Firm*—John C. Garvin, Jr.; James E. Staudt

[57] ABSTRACT

A system for controlling adjustment of the outboard drive unit of a boat by operation of switches mounted on the steering wheel of the boat. The system provides an "up switch, a "down" switch and a transmitter, each of which is adapted for attachment adjacent the gripping portion of the steering wheel. The transmitter provides wireless command signals to a receiver which is adapted for mounting behind the dashboard of the boat. The receiver in response to reception of the signals actuates an relay interface which in turn actuates a selected "up" or "down" trim relay which is a standard component on boats for which the kit is intended. The actuated trim relay provides electrical power to a conventional boat trim drive mechanism which in accordance with the switch command adjusts the position of the drive unit of the boat. The system may be provided in kit form which would include a transmitter unit and a receiver unit each of which includes the necessary ancillary equipment necessary for operation and for attachment to a boat.

5 Claims, 4 Drawing Sheets

WIRELESS TRIM CONTROL SYSTEM FOR BOAT DRIVE

TECHNICAL FIELD

This invention relates to a wireless trim control system for adjusting the drive unit of a boat. The system includes a switch actuated transmitter attached to the steering wheel of a boat for transmitting wireless signals to a receiver which in turn provides electrical signals for adjusting the position of standard boat trim apparatus. The system may be installed as original equipment, and is also particularly well suited for use in kit form for installation on boats which have power means for adjusting the drive units or having other types of power trim adjustments. Such a kit which would include a transmitter unit and a receiver unit each of which include the necessary ancillary equipment necessary for operation and for attachment to a boat.

BACKGROUND OF THE INVENTION

Altering the trim of a power boat so as to improve the boat's performance, is generally accomplished by tilting the angle or the depth of the boats' propeller, or by operation of separate devices such as trim tabs. As is well known the majority of modern pleasure boats utilize an outdrive system wherein the propulsion mechanism, i.e., the propeller and the apparatus which connects the propeller to the boat motor, is positioned outside the stern of a boat. This propulsion mechanism is commonly referred to as a drive unit. Outdrive systems include the inboard/outboard type wherein the engine is located inside the boat and is attached to the drive unit by pivots which allow the drive unit to be angularly tilted as well as directionally rotated. The other common outdrive system is the outboard motor which is attached to the boat in a way that permits tilting of the engine and the rigidly attached drive unit as one. In some cases the outboard motor is attached to the boat by means of a jacking apparatus commonly referred to as a jack plate which provides the additional capability of moving the entire outboard motor and the attached drive unit vertically with respect to the boat. This feature is utilized to aid the trimming of a boat while underway and provides the additional capability of raising the outboard motor vertically for effective operation in shallow water. On typical inboard boats wherein the propeller is maintained in a fixed position relative to the boat, trimming the boat is accomplished by trim tabs which are plates typically attached one to each side of the stern of the boat and positioned at an angle so as to force the stern of the boat upwardly as the boat passes through the water. The angle of these trim tabs may be adjusted to vary the lifting force applied to the stern. These various types of boat trim mechanisms are often utilized in combination with one another.

The prior art abounds with power operated mechanisms for tilting outboard motors and/or inboard-outboard drive units. These power-operated mechanisms are particularly useful to tilt the larger high-powered outboard motors which are extremely difficult to handle manually and for holding the outboard motor in a maximum upwardly tilted position when the boat is positioned on a trailer for towing. Typically the drive unit of inboard outboard boats is similarly tilted for towing. These power-operated mechanisms are especially useful to tilt the outdrive systems to a most efficient angle relative to the transom of the boat to achieve peak performance of the motor and the boat irrespective of the distribution of weight within the boat.

The switches for actuating the power-operated mechanisms for tilting outdrive systems are usually positioned on the upper end of a control lever, mounted on the sidewall of the boat on one side of the operator. Typically these control levers operate both the throttle and the shifting linkages. The switches for trimming boats having high powered motors such as those used by professional bass fishermen and others who travel at high speeds, are likewise normally mounted on the upper end of the control lever. This arrangement is inconvenient in that the operator must remove one hand from the steering wheel each time an adjustment is made. Achieving the proper trim of the boat under changing water conditions, as well as changes in the weight distribution within the boat, requires an almost constant series of corrections. Thus, it is clear that the constant hand movement between the trim switches and the steering wheel, is very disconcerting to the operator of the boat. It is also clear that the safe operation of the boat is also impaired, particularly when the boat is operated at high rates of speed. Since the operator of such a high speed boat must remove one hand from the steering wheel to actuate the switches to trim the boat, it is apparent that the resulting steering of the boat with only one hand instantly creates a hazardous driving condition. Thus, for the sake of convenience and more importantly for safety, it is desirable to relocate the switches to the steering wheel so that the operator may trim the boat while keeping both hands on the steering wheel.

U.S. Pat. No. Re 27,932 to Mettetal, Jr. discloses several embodiments of typical, prior art, mechanisms for tilting an outboard motor namely: a combination hydraulic and electrical circuit mechanism (FIGS. 1–4); a hydraulic mechanism (FIGS. 5–7); and a mechanical screw and nut mechanism (FIGS. 8–10). The present invention is adaptable for use with any of these types, or other types, of mechanisms for tilting the drive unit of a boat.

U.S. Pat. No. 5,337,694 to Nix et al discloses a boat trim kit having a switch assembly for mounting on the steering wheel and wherein trim signals are directed to the outdrive via a wiring harness which is coiled around the steering shaft and contained within a chamber housing which is attached to the dashboard of the boat.

Several kits are available for relocating boat trim actuating switches to the steering wheel, dashboard or the floor of a boat. Examples of such kits are depicted on pages 7 and 8 of the 1989/1990 Catalog of T-H Marine Supplies, Inc., 118 Celtic Circle Madison Ala. These and all other known kits have several disadvantages which in most cases are related to the fact that previous forms of trim control systems require wiring or sliding metal contacts to connect the switches that one would actuate to control the relays that drive the trim mechanisms. This problem is particularly troublesome when mounting the actuation switches on the steering wheel of a hydraulic steering system. With a typical hydraulic steering system a pressure relief valve permits turning the steering wheel continuously in either direction with additional effort when the boat drive unit reaches it maximum turning travel. Thus, unlike conventional mechanical systems, such a system has no positive "stop" to limit the rotation of the steering wheel. This presents a problem when mounting many of the otherwise preferred steering wheel mounted trim controls. In particular the problem arises with controls which utilize a switch set mounted on the steering wheel with a coil cord that runs to the trim mechanism wiring in the boat's console and include a switch set mounted on the steering wheel with a concealed wiring bezel to connect to the trim mechanism wiring. With a hydraulic system these devices can only turn to the limit of their wiring at which time they prevent the wheel from further turning or if forced the wiring would break. These kits have an additional disadvantage in that the cable leading from the switches to the power trim wiring harness, coils or wraps around the steering column or shaft when the steering wheel is rotated. This provides a very cumbersome system which is difficult to install, is susceptible to frequent failure from chaffing and tangling of the wires and is quite difficult and expensive to repair.

It is an objective of the present invention to provide a wireless trim control system for adjusting the trim of a power boat, which system eliminates the need for removal of either of the operators hands from the steering wheel of the boat when adjusting the trim.

It is an object of the present invention to provide a relatively inexpensive kit for locating or relocating on the steering wheel, the switches of a power-operated mechanism which tilts and also vertically adjusts an outboard motor.

It is another object of the present invention to locate on the steering wheel of a vehicle the switch assembly and a wireless transmitter which energizes a component of the vehicle which modifies the operation of the vehicle.

It is yet another object of this invention to provide the power-operated mechanisms for adjusting the position of the drive unit of a boat with a wireless means located on the steering wheel which transmits wireless signals to a remotely located receiver, which in response to these signals provides such adjustments.

Additional benefits and advantages of the present invention will become apparent to those skilled in the art to which this invention relates from the subsequent description of the preferred embodiments and the appended claims, taken in conjunction with the accompanying drawings.

DESCRIPTION OF THE PREFERRED EMBODIMENT

Figure 1:
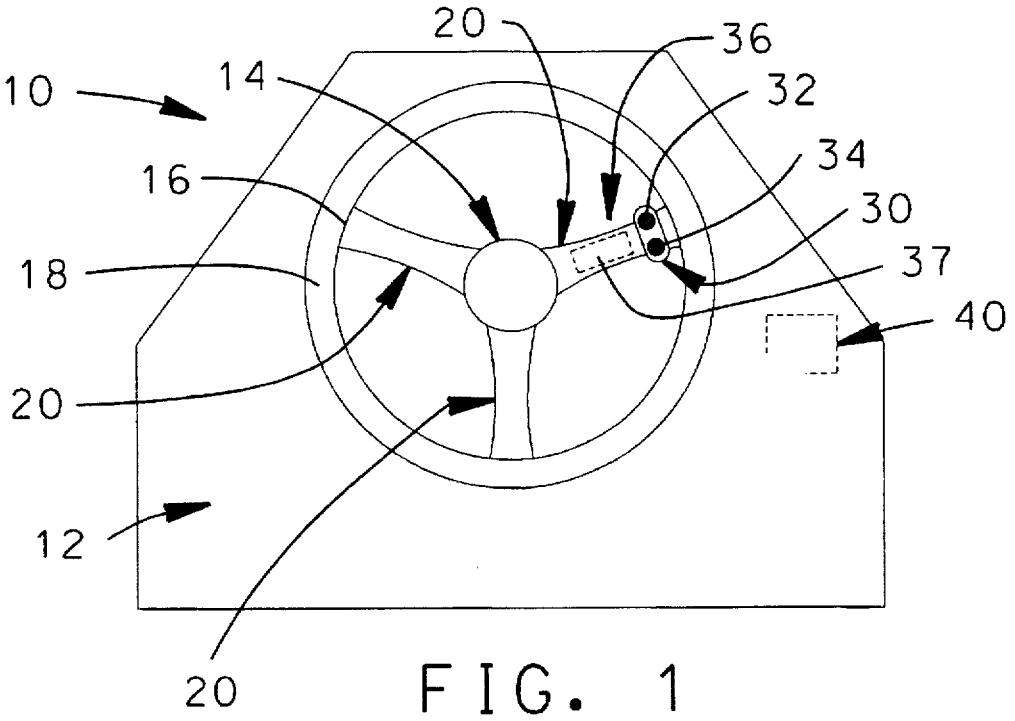
FIG. 1 is a front elevational view of a steering wheel mounted to the dashboard of a boat and showing a set of remote control switches attached to the face of the steering wheel, a transmitter electrically connected to the switches and mounted behind the steering wheel, and a receiver mounted behind the dashboard.
Figure 2:
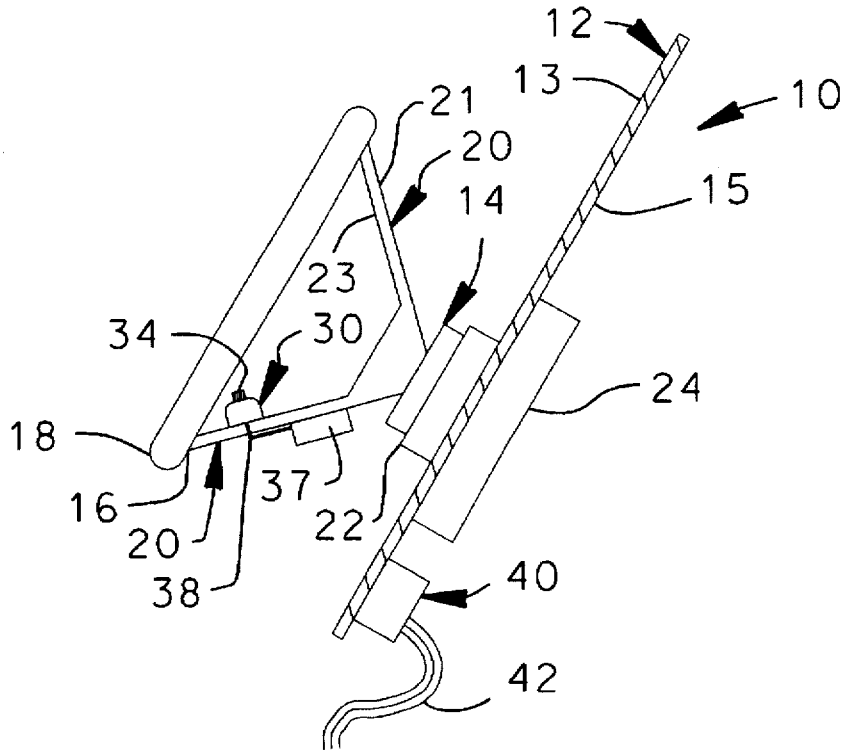
FIG. 2 is a side elevation of the device illustrated in FIG. 1 showing the details of the mounting of the control switches and the transmitter to the steering wheel, and the receiver to the dashboard.

Referring now to FIG. 1 of the drawings, a standard boat steering and dashboard assembly 10, to which the present invention is to be attached, is illustrated. As illustrated in FIG. 2, this assembly includes a dashboard 12 through which a portion of a steering mechanism 14 passes and is attached thereto. The steering mechanism includes a steering wheel 16 having an annular wheel grip 18 and a plurality of wheel spokes 20. Each of the spokes 20 has a forward surface 23 and a back surface 21. The steering wheel 16 is rotatably attached to the dashboard 12 by means of a bezel base mount 22. The dashboard 12 has a face surface 13 and an inner surface 15. As is typical the steering wheel attaches to a steering shaft (not shown) which passes through the bezel base mount 22 for actuation of a standard steering system (not shown) a portion of which is contained within a steering box 24.

Figure 4:
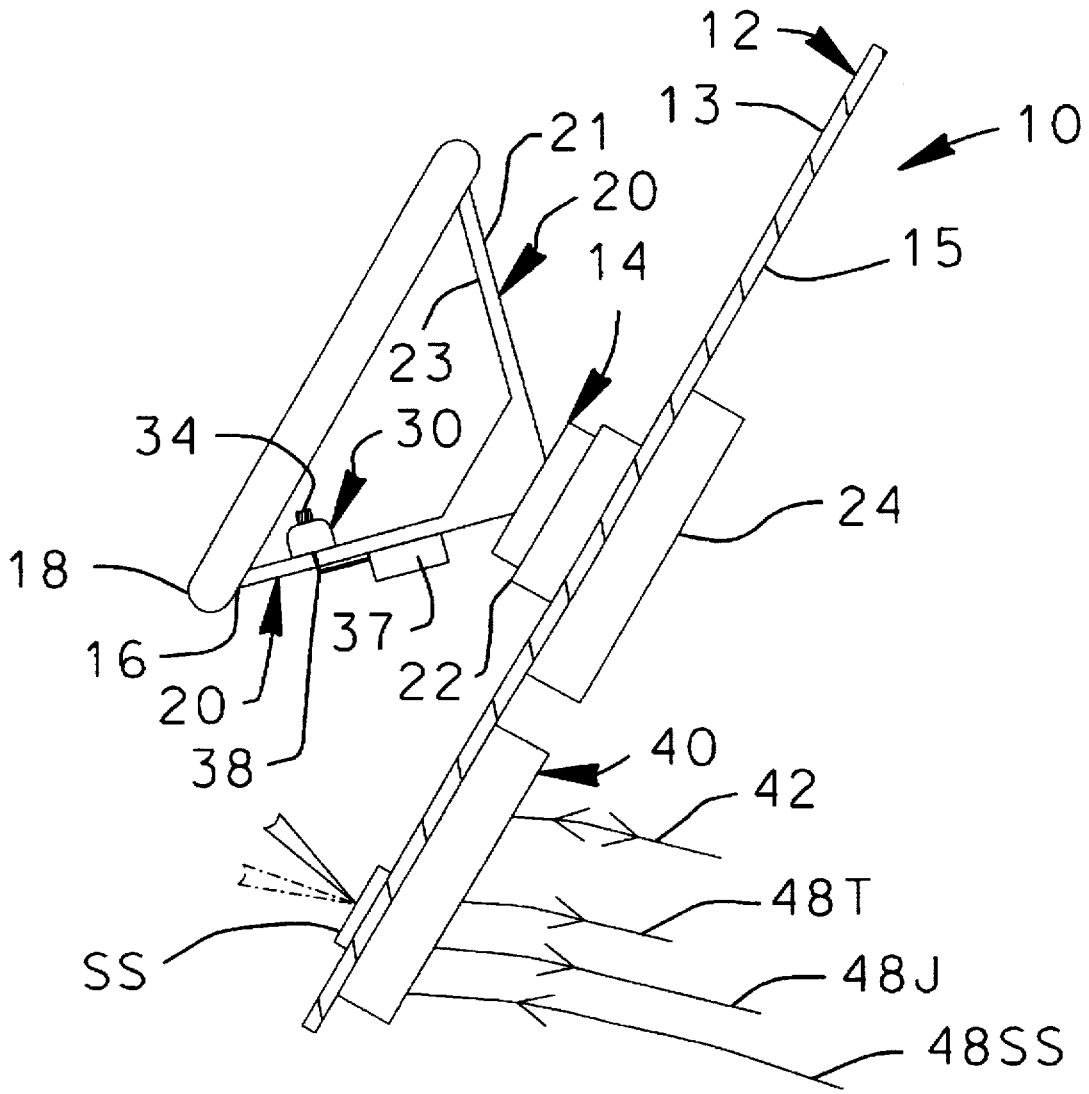
FIG. 4 is a side elevation of a second embodiment of the invention showing the mounting of a selector switch with respect to dashboard of the boat and to the receiver unit.
Figure 5:
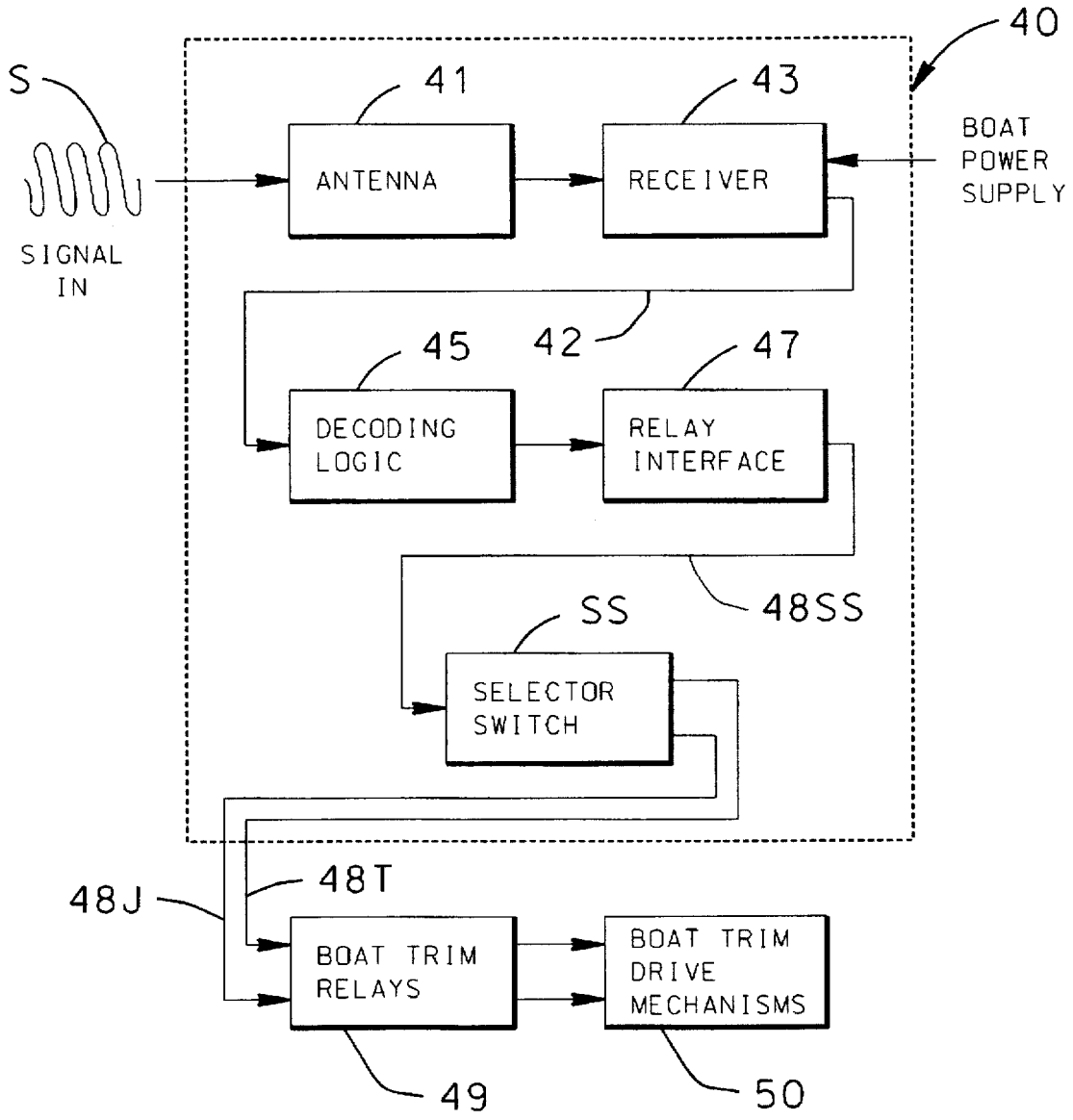
FIG. 5 is a block diagram of the device illustrated in FIG. 4 and showing the operation of the selector switch within the receiver unit.

To this standard boat steering assembly is added the wireless remote trim control system which is the subject of this invention. As illustrated in FIGS. 1 and 2, this system includes a switch assembly 30 which includes an "up" tilt switch 32 and a "down" tilt switch 34. As illustrated the switches are of the push button type which are spring biased to an "off" position, however an "up","down" toggle or sliding switch may be utilized for certain applications. Use of a toggle or sliding switch would require that the normal position of the switches would be "off" and that the switches would be operated against a spring bias. Switches having additional functions such as a preset tilt positioning switch may be added to the switch assembly if desired, or additional switches may also be attached adjacent the switch assembly 30 or to an opposing wheel spoke for operation with the opposite hand. The push button type switch is particularly useful on boats which require frequent tilt adjustments while running at high speeds, but wherein the adjustments must be gradually changed as the boat progresses from the stopped condition through the slow and midrange conditions of operation. As best illustrated in FIG. 2, a transmitter unit 36 includes control switch assembly 30, transmitter 37 and connecting wire set 38. More specifically, the control switch assembly 30 is mounted on a spoke 20 immediately adjacent the annular grip 18. This location is obviously the most efficient possible, in that the thumb of a boat driver is immediately adjacent the switches, thus permitting instant operation of the switches without movement of the hand position from wheel grip 18. The transmitter 37 is attached to the back side 21 of a spoke 20 and adjacent the control switch assembly 30. The transmitter 37 is electrically connected to the switch assembly 30 by wires within a wire set 38 which may be routed either through an aperture in the spoke or around either side thereof. A receiver unit 40 is secured on the back side 15 of the dashboard 12. A wiring set 42 carries power from the electrical system of the boat to power the receiver and also carries the electrical control signals from the receiver through other components, which will be described hereinafter, to standard boat trim relays. It is noted that a variety of frequency ranges are utilized for operation of remote control systems. Common examples include infrared and radio frequencies. In operation of the present system the use of a radio frequency transmitter is uniquely suited for several reasons. As is well known, radio frequencies radiate in all directions from the transmitter and are capable of passing though many materials. In the present arrangement the receiver is located a very short distance from the transmitter and is typically mounted on the back side 15 of the fiberglass dashboard 12. Accordingly, this arrangement lends itself to use of the smallest possible battery which in turn permits the transmitter 37, which contains the battery, to be miniaturized to a size which is easily accommodated behind a spoke 20 of steering wheel 16. It is to be understood however that the receiver may be placed in any part of the boat as dictated by convenience and effective operation of the system. As illustrated in FIGS. 4 and 5, a second embodiment of the invention utilizes a toggle type selector switch SS which is attached to face 13 of the dashboard 12. This switch provides the operator of the boat with the choice of actuating a typical tilt type trim mechanism or a less common jack plate trim mechanism which raises or lowers an outboard motor vertically. This vertical raising and lowering of the outboard motor provides the capability of improving the high as well as the low speed performance of the boat and provides the additional capability of raising the motor for shallow water operation.

Figure 3:
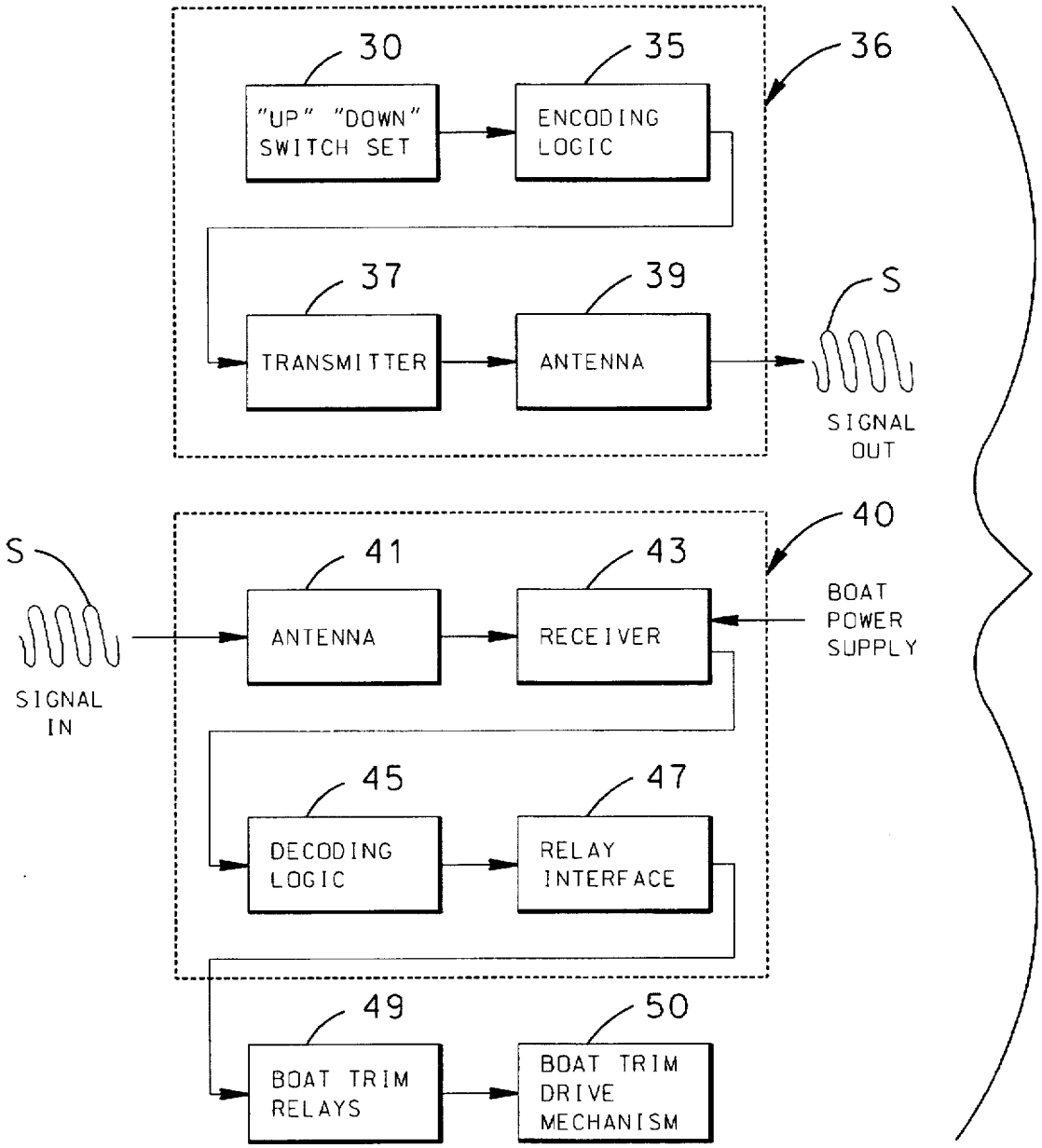
FIG. 3 is a block diagram illustrating the sequence of operation of the device from operation of the switches to actuation of standard boat relays which in turn trigger operation of standard boat trim drive mechanisms.

Referring now to the operational block diagram as set forth in FIG. 3, it will be seen that the switch assembly 30 may be operated to tilt the drive unit of a boat in either the "up" or "down" direction by depressing the desired switch button. Thus operation of either the "up" switch 32 or the "down" switch 34 directs an appropriate electrical signal to the encoding logic 35 which triggers a transmitter 37 to broadcast a signal of an appropriate frequency through an antenna 39 which emits a signal S into the surrounding atmosphere. It will be noted that the switch assembly 30, the encoding logic 35, the transmitter 37 and the antenna 39 are contained within the transmitter unit 36. As previously stated, the transmitter unit is powered by a miniature Direct Current battery (not shown) which is also located within the transmitter 37. The signal S is received by an antenna 41 of a receiver 43 which provides an electrical signal to a decoder logic 45. The decoder logic 45 analyzes the signal to determine whether it came from the "up" switch 32 or from the "down" switch 34 and then provides an appropriate electrical signal to a relay interface 47. In response to the signal from the decoding logic 45, the relay interface 47 actuates an appropriate "up" or "down" relay within the standard boat trim relays block 49 which in turn actuates the boat trim mechanism as illustrated in block 50. As noted above and illustrated in FIGS. 4 and 5 the second embodiment of the invention utilizes a selector switch SS which provides the boat operator with the option of activating either a conventional tilt type trim mechanism or if the boat is so equipped the less common jack plate trim mechanism which serves to raise or lower an outboard motor. It will therefore be readily understood that in one position the selector switch would actuate the standard "jack plate" trim mechanism located within the boat trim block 50 through appropriate boat trim relays within the boat trim relays block 49 via the wiring set 48J. Conversely while the selector switch is in the other position, the tilt type trim mechanism also located within the boat trim drive mechanisms block 50 would be actuated via separate boat trim relays upon receipt of an electrical signal through wiring set 48T. As illustrated in FIG. 5, it will be noted that the antenna 41, the receiver 43, the decoding logic 45, the relay interface 47 and the selector switch SS are contained in the receiver unit 40.

It will be noted that since the boat trim relays and the boat trim drive mechanism are standard equipment on boats upon which this invention is to be utilized the details of these components are not shown or described in detail herein, however, the basic operation of these standard boat components in cooperation with the present wireless control system is provided hereinafter. The boat trim relays 49 function to receive a low power electrical signal from the relay interface 47. This signal actuates at least one of the boat relays 49 which then closes a heavy duty switch within the relay. The closing of the relay switch provides a high power electrical current from the boats standard electrical system to the standard "up" or "down" electrical drive system within the boat trim drive mechanism 50. In the case of the embodiment illustrated in FIGS. 4 and 5, depending upon the position of selector switch SS the selection is made to actuate the boat trim drive mechanism which tilts the outboard motor or to actuate the boat trim mechanism which adjusts the motor vertically.

Obviously, numerous modifications and variations of the present invention are possible in light of the above teachings. For example, the present invention may be used with any steerable vehicle wherein it would be advantageous to control the operation of various equipment by operation of switches mounted upon the steering device of the vehicle. The invention may of course be utilized during vehicle manufacture and is obviously particularly well suited for use in kit form. It is therefore to be understood that within the scope of the appended claims the invention may be practiced otherwise than as specifically described herein.

We claim:

1. In a boat having a fiberglass dashboard with a face surface and an inner surface, and a steering wheel having a forward surface and a back surface rotatably secured adjacent said dashboard, a drive unit, and power tilt means for tilting said drive unit relative to said boat, a control system for operatively connecting said power tilt means to said steering wheel, said control system comprising:

a transmitter attached to the back surface of said steering wheel and in close proximity to said dash board for transmitting wireless signals of selected frequencies;

switch means adjustably attached to the forward surface of said steering wheel for actuating said transmitter for transmission of said wireless signals of selected frequencies;

receiver means attached to the inner surface of said fiberglass dashboard and in close proximity to said transmitter for receiving said transmitter signals and for actuating said power trim means in response to said wireless signals received by said receiver means whereby operation of said switch means will tilt said drive unit to any desired position by actuation by an operator of said boat which actuation may be accomplished while maintaining a grip on said steering wheel with both hands.

2. A control system as set forth in claim 1 wherein said receiver means includes selector switching means for actuating selected of said trim drive mechanisms in response to reception of selected of said frequencies by said receiver means.

3. In a boat having an electrical power supply, a dashboard having a face surface and an inner surface, a steering wheel rotatably attached to said dashboard and having a gripping portion and a plurality of spokes attached thereto each of said spokes having a forward surface and a back surface, a drive unit attached to said boat, and boat trim drive mechanisms for adjusting the position of said drive unit with respect to said boat and boat trim relays for actuation of each said boat trim drive mechanisms, a kit for providing a wireless control system for controlling the adjustment of said drive unit, said kit comprising:

transmitter means, having an internal power supply, for transmitting wireless signals of selected frequencies;

switch means disposed for electrical connection to said transmitter for selective actuation of said transmitter for transmission of one of said selected frequencies;

receiver means, disposed for electrical connection to said boat power supply, for reception of said selected wireless signal and in response thereto for selective actuation of said boat relays for actuation of said boat trim drive mechanism;

said switch means disposed for attachment to the forward surface of one of said spokes adjacent said gripping portion of said steering wheel, and said transmitter means disposed for attachment to the back surface of said spoke and adjacent said switch means;

said receiver means disposed for attachment to the inner surface of said dashboard and including selector switching means for actuating selected of said trim drive mechanisms in response to reception of selected of said frequencies by said receiver means.

4. A kit as set forth in claim 3 wherein said selector switching means is disposed for attachment to the face surface of said dashboard.

5. A control system as set forth in claim 2 wherein said selector switching means is attached to the face surface of said dashboard.

* * * * *